United States Patent [19]

Obrist et al.

[11] 4,345,692

[45] Aug. 24, 1982

[54] CLOSURE CAP FOR A CONTAINER

[75] Inventors: Albert Obrist, Kaiseraugst; Hans Breuer, Balsthal, both of Switzerland

[73] Assignee: Albert Obrist AG, Reinach, Switzerland

[21] Appl. No.: 233,884

[22] Filed: Feb. 12, 1981

[30] Foreign Application Priority Data

Feb. 14, 1980 [CH] Switzerland ..... 1203/80

[51] Int. Cl.[3] ..... B65D 41/34

[52] U.S. Cl. ..... 215/252

[58] Field of Search ..... 215/252, 246; 53/488

[56] References Cited

U.S. PATENT DOCUMENTS 3,329,295 7/1967 Fields ..... 215/252
3,673,761 7/1972 Leitz ..... 215/252
4,196,818 4/1980 Brownbill ..... 215/252
4,206,852 6/1980 Dunn et al. ..... 215/252

FOREIGN PATENT DOCUMENTS 2638385 3/1977 Fed. Rep. of Germany ..... 215/252
1384370 2/1975 United Kingdom .

*Primary Examiner*—Donald F. Norton
*Attorney, Agent, or Firm*—William R. Hinds

[57] ABSTRACT

In a closure cap for containers having a guarantee strip of thermoplastically deformable material, connected to the cap by rupturable connecting web portions and which can be moulded to or shrunk on to the neck of a container by the application of heat, the guarantee strip is enlarged in the region between each two successive connecting web portions. The material structure is thereby homogenized and improved and the shrink properties improved.

6 Claims, 6 Drawing Figures

CLOSURE CAP FOR A CONTAINER

FIELD OF THE INVENTION

This invention relates to a closure cap, for a container provided with a guarantee strip produced integrally with the cap from thermoplastic material by an injection moulding process wherein the guarantee strip is connected to the lower edge of the closure cap by a plurality of rupturable connecting web portions. The guarantee strip is intended to surround at least partially the neck of the container, and, after the closure cap has been fitted on to the neck of the container, can be form-lockingly moulded thereto and brought into engagement therewith by hot deformation.

BACKGROUND

Closure caps for containers, in particular bottles, which are produced by an injection moulding process, are known and conventional in a very wide range of configurations.

In regard to such closure caps, a problem arises because it is desirable for the guarantee strips to be shaped in a manner which requires the application of the minimum amount of heat. This requirement arises both in regard to economy and also in particular because the operating rates in automatic closure equipment are constantly increasing and therefore the amount of time available for hot deformation of the guarantee strip is constantly being reduced. Filling equipment with a capacity of over 40,000 bottles per hour is already in use in the drinks industry.

It is therefore desirable for the guarantee strip to be moulded to the container, without using a mechanical tool, solely by the application of heat or by the application of heat and compressed air, as this makes it possible to avoid the delays inherent in the use of mechanical tools.

PRIOR ART

British Pat. No. 1384370 (United Glass) discloses a closure cap which, by producing a guarantee strip with an elementary preferential direction, is intended to ensure an automatic 'shrink effect' when heat is applied. This closure cap can be produced only with difficulty as it is necessary to use an extremely expensive tool which gives only low production rates. In particular, lateral injection of the plastics material in the region of the guarantee strip requires a technically highly complicated tool, in which respect the construction principle in regard to multiple moulds can give rise to particular difficulties.

SUMMARY OF THE INVENTION

An object of the present invention is to avoid the disadvantages of the known art, in particular, by providing a closure cap of the above-indicated kind of which the guarantee strip is plasticised by applying only small amounts of heat, without tearing when that is done. Caps according to the invention may be produced with moulds which can be filled from the top of the cap and into the guarantee strip by way of the design-rupture connecting web portions.

In a closure cap according to the present invention, the wall thickness of the guarantee strip has an enlargement in the region between each two successive rupturable connecting web portions. This enlargement, that is to say this increase in the thickness of material, produces a number of surprising results. It ensures that, in the injection operation, when the liquefied thermoplastic material is injected into the guarantee strip portion from the connecting web portions, the two flows of material which are moving towards each other come into contact with each other over a large area so that the guarantee strip is strengthened in that region. In addition, in the subsequent application of heat in the shrink operation, the guarantee strip enjoys sufficient strength and stability between each two successive design-rupture connecting web portions by virtue of the increasing and decreasing thickness of material, even if for example the plasticisation temperature is exceeded.

In the extreme case, this can mean that the guarantee strip shinks in the region between the enlarged portion and the subsequent design-rupture connecting web portion, while remaining rigid in the region of the enlargement. This partial shrink effect in a plurality of partial regions around the periphery of the guarantee strip is however fully sufficient for form-lockingly moulding the guarantee strip to the container. The arrangement also ensures that, if an excessive amount of heat energy is applied, for example due to an oversight, the guarantee strip is not destroyed. In fact, even if, in such a situation, the portions between the enlargements and the design-rupture connecting web portions are overheated and become excessively plastic, so that normally the guarantee strip would suffer damage, the guarantee strip remains firm and strong in the region of the enlarged portions, because of the greater amount of material. This means that the guarantee strip does not have large sections which 'droop' or 'hang down', but only short sections between the enlarged portions which may sag somewhat more severely, without however detrimentally affecting either the function or the appearance of the guarantee strip.

The invention provides a guarantee strip which can be plasticised quickly and with a small amount of applied heat, in the region between the enlarged portions, and a guarantee strip which is more resistant than known guarantee strips, over a wide region, when subjected to overheating.

Preferably the enlargement is provided on the inward side of the guarantee strip and is of an approximately chord-like configuration. This permits particularly simple manufacture by an injection moulding process.

Particularly good results have been obtained in practice when the enlargement is about 8 to 25% of the wall thickness of the guarantee strip.

With bottle closures fitted in high-speed equipment and hot-formed with wide temperature tolerances, it has been found that the best results, both from the point of view of function and also from the visual aspect can be achieved if the enlargement is from about 10 to 15% of the wall thickness of the guarantee strip. Preferably, the guarantee strip used has a wall thickness of from about 0.35 to 0.45 mm, while the enlargement is from about 0.03 to 0.07 mm.

It will be appreciated that the technical advance and inventive content of the invention are provided both by the individual novel features and by the combination and sub-combinations of these features.

BRIEF DESCRIPTION OF THE DRAWINGS

Other parts of the invention are embodied in the preferred embodiments thereof which will now be described in some detail by way of example and with reference to the accompanying drawings, in which.

DESCRIPTION OF PREFERRED EMBODIMENT

Figure 1:
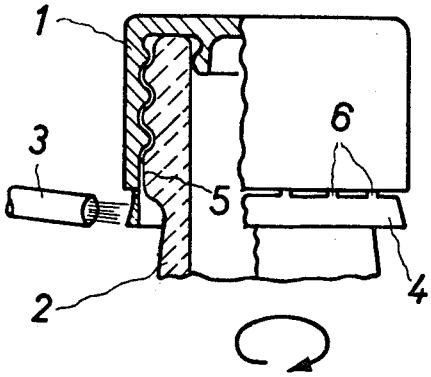
FIG. 1 is a diagrammatic view partially in section of a form of screw cap according to the invention.

Referring to FIG. 1, a closure cap 1 fitted on to a neck 2 of a container, is exposed to the air flow of a laterally disposed hot air nozzle 3. During this heating operation, the container neck 2 is rotated in such a way that the whole periphery of the closure cap 1 is subjected to the action of the hot air nozzle 3, in the plane of the guarantee strip 4. This causes the guarantee strip 4 to be plasticised and laid around an annular bead 5 on the neck 2 of the container. The guarantee strip 4 is then allowed to cool and harden, so that the neck 2 of the container is closed in a theft-proof manner by the closure cap 1. The guarantee strip 4 lies form-lockingly or positively about the neck 2 of the container and the closure cap 1 can only be removed from the container neck 2, by tearing the design-rupture connecting web portions 6.

Figure 2:
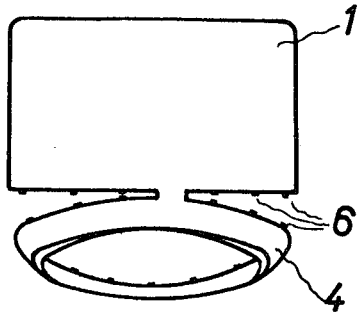
FIG. 2 shows the screw cap of FIG. 1 with the guarantee strip shaped and partly torn-off.

FIG. 2 shows a guarantee strip 4 which has been torn open, with the connecting web portions 6 having been torn in the above-described manner upon removal of the cap from the container neck 2.

Figure 3:
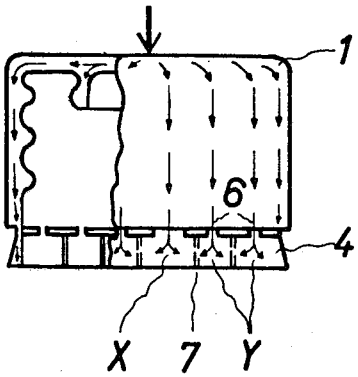
FIG. 3 is a diagrammatic view of the flow of material during injection moulding the screw cap shown in FIG. 1.

The plurality of connecting web portions 6 makes it possible, when injection moulding the closure cap 1, to have a mould arrangement which is filled from the end portion of the cap, as illustrated by arrows in FIG. 3. In the mould filling operation, the fluid thermoplastics material passes through the connecting web portions 6 into the region of the guarantee strip, with the individual partial flows X and Y, which occur downstream of the respective connecting web portions 6, meeting approximately midway between two connecting web portions 6. In the region of the separation line 7 at which the two flows X and Y meet, the plastics material needs to be of greater thickness, in order to form a mechanically firm and strong bond, than in the remaining part of the guarantee strip 4 in which there is a homogeneous and laminar material structure.

Figure 4:
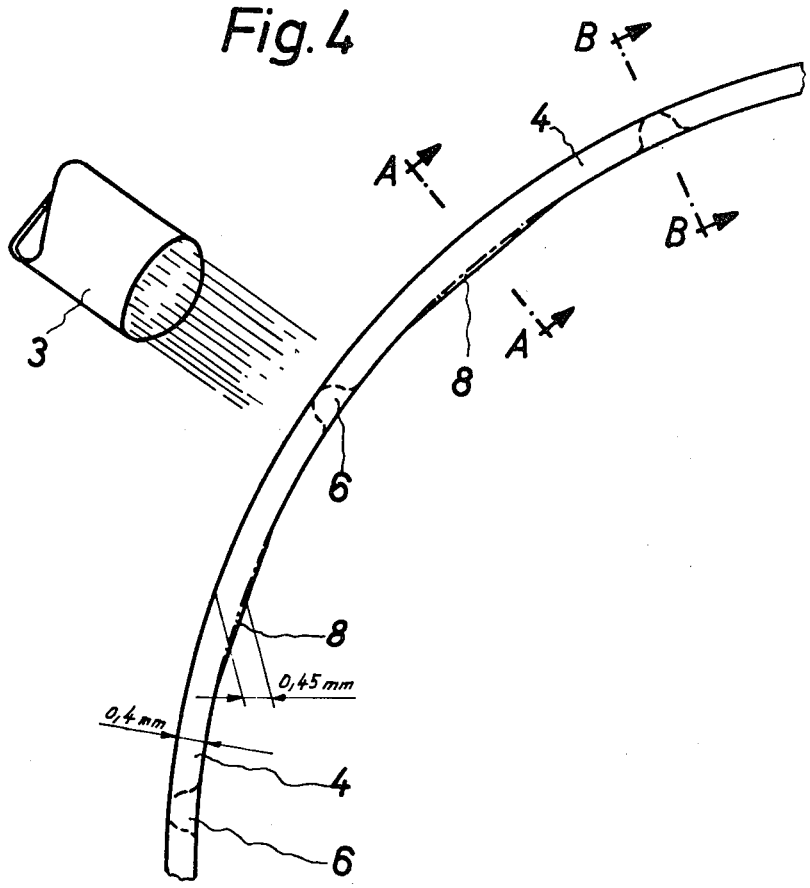
FIG. 4 is a view to an enlarged scale in section through the guarantee strip of the screw cap shown in FIG. 1.
Figure 5:
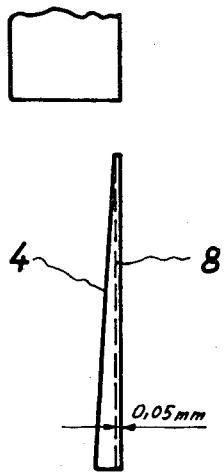
FIGS. 5 and 6 show sectional views, along lines A—A and B—B, respectively, of FIG. 4, through the guarantee strip shown in FIG. 4.
Figure 6:
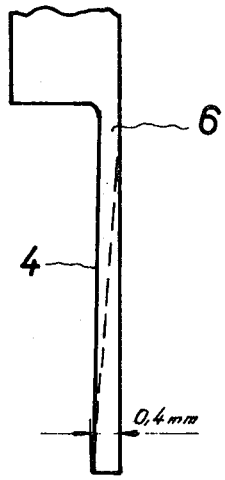

In that region therefore, as shown in FIGS. 4 to 6, there is a plan view of FIG. 4, in the form of a chord-like interruption in the inside wall surface of the guarantee strip 4, which is of a circular configuration. The increased-thickness portion can be produced in a particularly simple manner because the inside wall surface of the guarantee strip 4 is of a slightly outwardly tapered configuration over the rest of the guarantee strip, and the enlarged portion provides a simple transition of the inside wall surface to a cylindrical configuration.

It will be appreciated that the increase in the thickness of material may be achieved in other ways, but this embodiment has been found to be particularly suitable for production-process reasons and with regard to the ease of removing the closure cap 1 from an injection moulding mould.

As shown in FIG. 6, the wall thickness of the guarantee strip 4 is 0.4 mm at its widest point. The enlargement 8 is 0.05 mm at the thickest point, so that the total wall thickness in the region of the enlargement 8 is increased to 0.45 mm.

When the guarantee strip 4 is heated by a hot air nozzle 3, the guarantee strip 4 is particularly severely softened in the portions between the connecting web portions 6 and the enlarged portions 8, and a shrink effect can be observed in respect of the entire guarantee strip 4, before a shrink action occurs in the region of the enlargement 8. The shrink effect, that is to say the reduction in the diameter of the guarantee strip, is produced by the combined effect of heat and pressure due to the flow of hot air out of the nozzle 3. Therefore, even if the guarantee strip 4 is softened only in a segmental manner in the sections between the enlargements 8, this will ensure that the closure cap 1 is firmly and theft-proofly fitted on to the neck 2 of the container.

We claim:

1. In a closure cap for a container comprising a cap portion, a guarantee strip, and a plurality of peripherally spaced rupturable web portions connecting the lower edge of said cap portion to said guarantee strip, said cap portion, guarantee strip and said web portions being integrally produced by an injection moulding process from a thermoplastics material, said guarantee strip being adapted to surround the neck of a container and to be form-locked thereabout by hot-deformation, the improvement in that the wall of the guarantee strip has an enlarged portion of relatively increased cross section and amount of material in the region between each two successive rupturable connecting web portions, said enlarged portions being separated by wall portions of relatively lesser cross section in the region of each said connecting web.

2. A closure cap as defined in claim 1 wherein the enlarged portion extends in a substantially chord-like configuration.

3. A closure cap as defined in claim 1 wherein the enlargement is from 8% to 25% of the wall thickness of the guarantee strip in the regions of said connecting webs.

4. A closure cap as defined in claim 1 wherein the enlargement is from 10% to 15% of the wall thickness of the guarantee strip in the regions of the connecting webs.

5. A closure cap as defined in claim 1 wherein the wall thickness of the guarantee strip is between 0.35 mm and 0.45 mm and the enlargement is between 0.03 mm and 0.07 mm.

6. A closure cap as claimed in claim 1 wherein said enlarged portions are circumferentially spaced sections of relatively increased wall thickness substantially equidistant between adjacent connecting web portions, the increased amount of material at each such section being accommodated at least in part by a relatively inwardly extending configuration of the inner wall surface at the section.

* * * * *